US010801358B2

(12) United States Patent
Wojciechowski et al.

(10) Patent No.: US 10,801,358 B2
(45) Date of Patent: Oct. 13, 2020

(54) INLET GUIDE VANE ALIGNMENT APPARATUS AND METHOD

(71) Applicant: GENERAL ELECTRIC COMPANY, Schenectady, NY (US)

(72) Inventors: Piotr Hubert Wojciechowski, Mazowieckie (PL); Lukasz Sajdak, Mazowieckie (PL); Szymon Perkowski, Mazowieckie (PL)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 16/043,305

(22) Filed: Jul. 24, 2018

(65) Prior Publication Data

US 2019/0063245 A1 Feb. 28, 2019

(30) Foreign Application Priority Data

Aug. 22, 2017 (EP) ..... 17461594

(51) Int. Cl.
*F01D 25/28* (2006.01)
*F01D 17/16* (2006.01)

(52) U.S. Cl.
CPC ..... *F01D 17/162* (2013.01); *F01D 25/285* (2013.01); *F05D 2230/64* (2013.01); *F05D 2230/644* (2013.01)

(58) Field of Classification Search
CPC ..... F01D 17/162; F01D 25/285
See application file for complete search history.

(56) References Cited

U.S. PATENT DOCUMENTS 8,033,785 B2 * 10/2011 Thermos ..... F01D 17/162 415/150
2009/0278294 A1 * 11/2009 Wang ..... F01D 25/285 269/9
2014/0144034 A1 * 5/2014 Spanos ..... F01D 25/285 33/645

FOREIGN PATENT DOCUMENTS

EP 1607581 A1 12/2005
GB 2459878 A 11/2009

OTHER PUBLICATIONS

European Search Report and Written Opinion dated Feb. 7, 2018 which was issued in connection with EP 17461594.8 which was filed on Aug. 22, 2017.

* cited by examiner

*Primary Examiner* — Woody A Lee, Jr.
(74) *Attorney, Agent, or Firm* — James Pemrick; Hoffman Warnick LLC

(57) ABSTRACT

An alignment apparatus for aligning inlet guide vanes in a turbine having a turbine axis includes a tool body, a positioning block secured to the tool body, and a plurality of alignment pieces secured to the tool body. The positioning block may be affixed to the tool body such that when the positioning block is engaged with a leading edge of one of the inlet guide vanes, at least a portion of the alignment pieces is parallel to the turbine axis. The alignment pieces may be manually displaceable from the OFF position to the ON position into engagement with the inlet guide vanes to align one or more of the inlet guide vanes.

20 Claims, 10 Drawing Sheets

INLET GUIDE VANE ALIGNMENT APPARATUS AND METHOD

BACKGROUND

The invention relates to turbine inlet guide vane alignment and, more particularly, to an apparatus and method that facilitates inlet guide vane alignment in the inlet case on the upstream side of the inlet guide vanes.

Conventional turbines, such as gas turbines, generally include a compressor section, a combustor section and a turbine section. In the compressor section, air is drawn in (e.g., from the surrounding atmosphere) and guided to the compressor using inlet guide vanes (IGVs). IGVs are conventionally arranged circumferentially about the axis of the compressor section. In an existing procedure, the IGVs are aligned one at a time, using a protractor-like measurement device to determine the proper angle and spacing of each IGV as it is placed within the compressor adjacent its neighboring IGV. The existing device relies on an angle measurement independent of the neighboring IGV. This process is performed during both installation and maintenance of the IGVs and can be time-consuming, costly and inaccurate.

BRIEF SUMMARY

In an exemplary embodiment, an alignment apparatus aligns inlet guide vanes in a turbine having a turbine axis. The alignment apparatus includes a tool body, a positioning rod secured to the tool body, and a plurality of eccentric pins secured to the tool body. Each of the plurality of eccentric pins is displaceable between an OFF position and an ON position. The positioning rod may be affixed to the tool body relative to the plurality of eccentric pins to place each of the eccentric pins adjacent a respective inlet guide vane when the positioning rod is engaged with an adjacent inlet guide vane and with the eccentric pins in the OFF position. The eccentric pins may be parallel to the turbine axis. The eccentric pins may be manually displaceable from the OFF position to the ON position into engagement with the respective inlet guide vanes.

In another exemplary embodiment, a method of aligning inlet guide vanes in a turbine includes the steps of (a) with the eccentric pins in the OFF position, positioning the alignment tool by placing the alignment tool on the turbine casing and engaging the positioning rod with an adjacent inlet guide vane; (b) securing the alignment tool to the turbine casing; and (c) displacing the eccentric pins from the OFF position to the ON position and engaging the eccentric pins with leading and trailing edges of the inlet guide vanes.

In yet another exemplary embodiment, an alignment apparatus for aligning inlet guide vanes in a turbine having a turbine axis includes a tool body, a positioning block secured to the tool body, and a plurality of alignment pieces secured to the tool body. The positioning block defines an axial limit position for the tool body relative to a leading edge of the inlet guide vanes. Each of the plurality of alignment pieces may be displaceable between an OFF position and an ON position. The positioning block may be affixed to the tool body such that when the positioning block is engaged with a leading edge of one of the inlet guide vanes, at least a portion of the alignment pieces is parallel to the turbine axis. The alignment pieces may be manually displaceable from the OFF position to the ON position into engagement with the inlet guide vanes.

DETAILED DESCRIPTION

Figure 6:
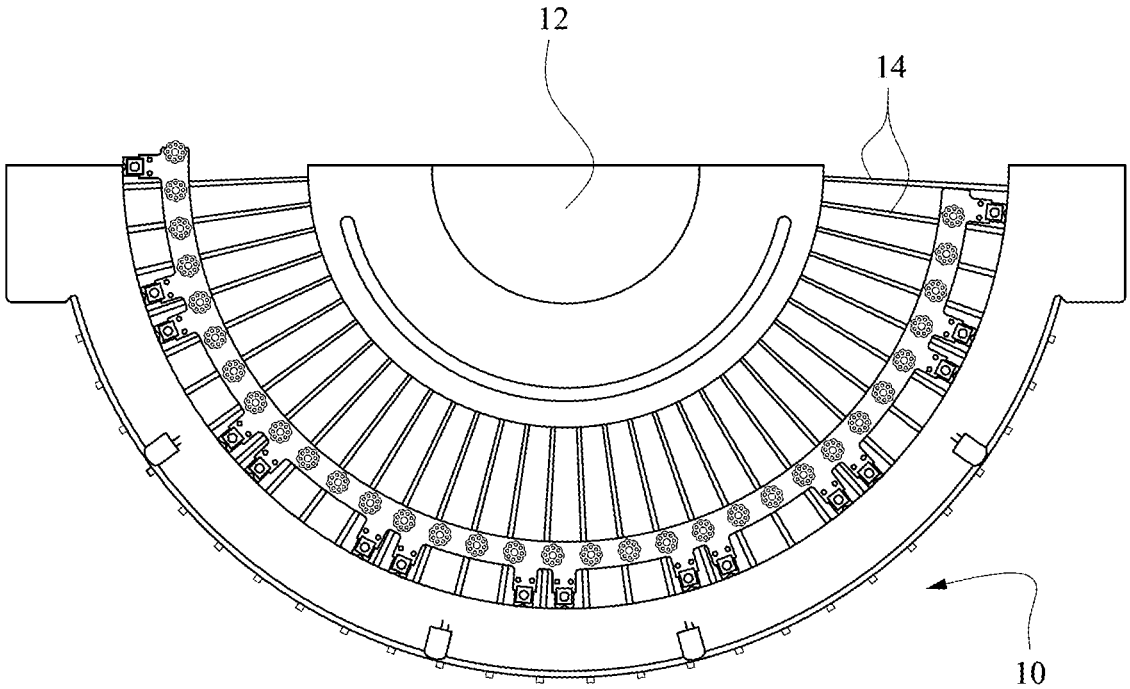
FIG. 6 shows a plurality of tool bodies aligned end-to-end to enable simultaneous alignment of a plurality of IGVs.

Inlet guide vanes (IGVs) in a gas turbine should be aligned during assembly (or re-aligned during maintenance) to maximize efficiency. FIG. 6 shows one-half of an inlet casing 10 and its axis 12 (extending into and out of the page). Proper alignment of the IGVs 14 is achieved when a line in contact with a leading edge 14*a* and a trailing edge 14*b* of each IGV 14 is parallel with the turbine or casing axis 12.

Figure 1:
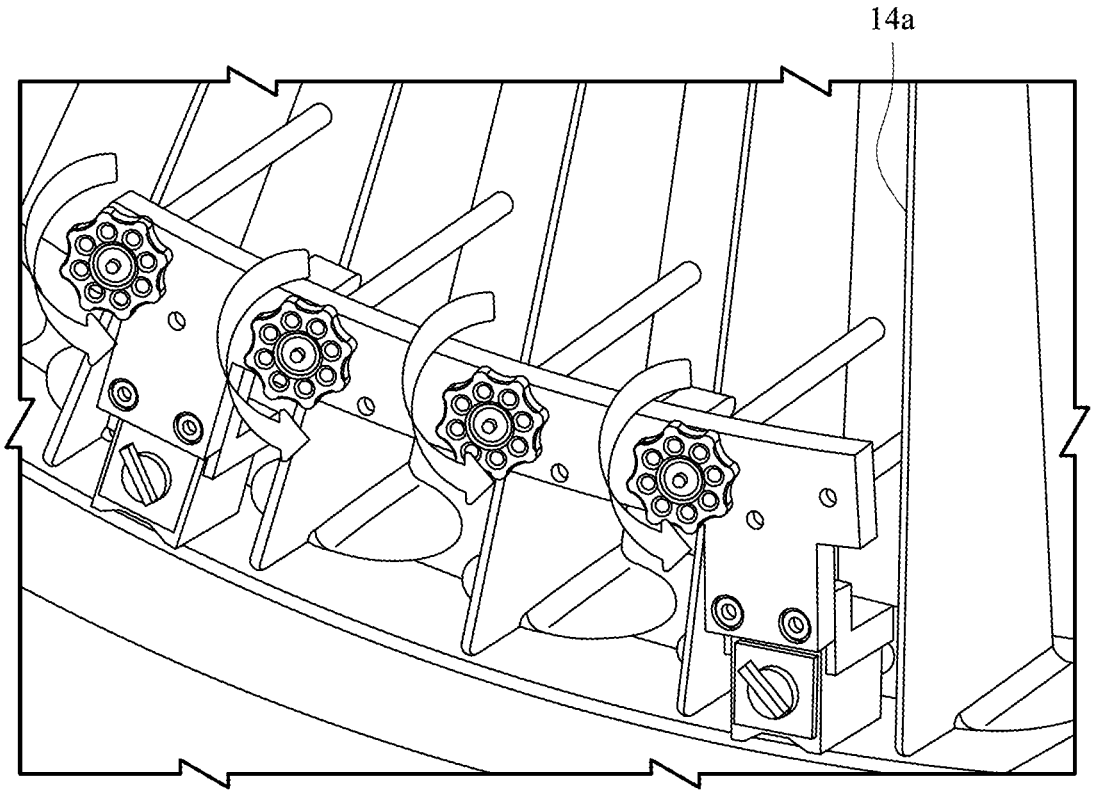
FIG. 1 is a perspective view of the alignment tool installed on an upstream side of the IGVs.
Figure 2:
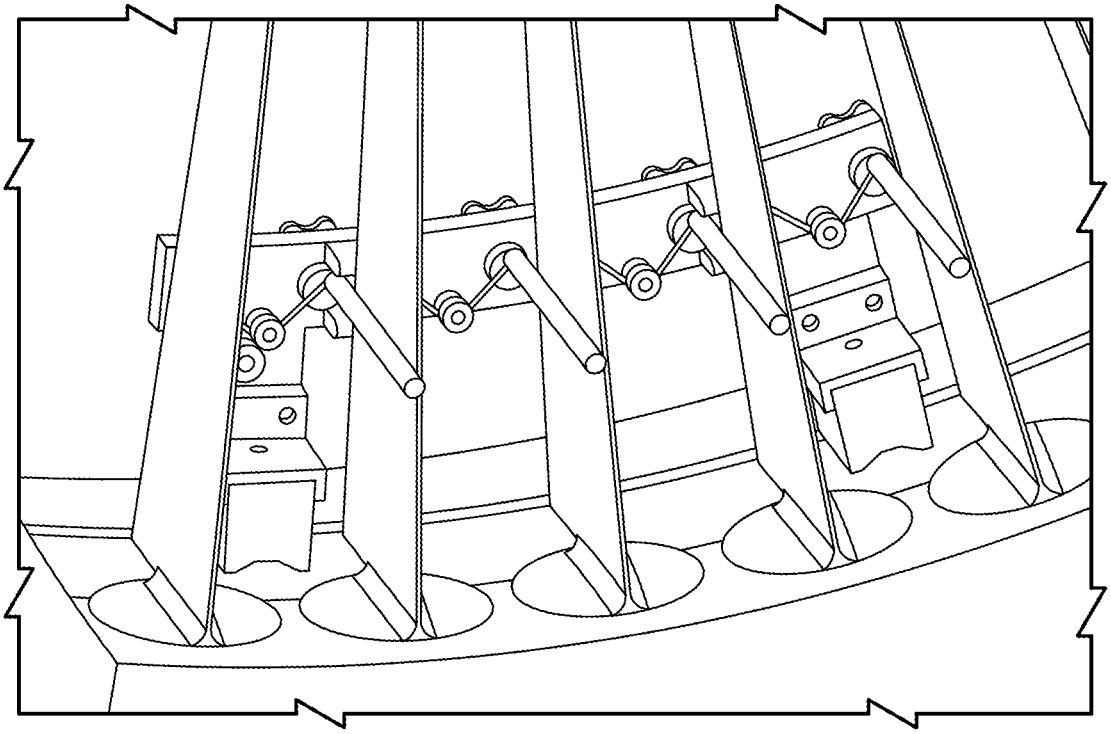
FIG. 2 is a view of the alignment tool from the opposite side of the IGVs.
Figure 3:
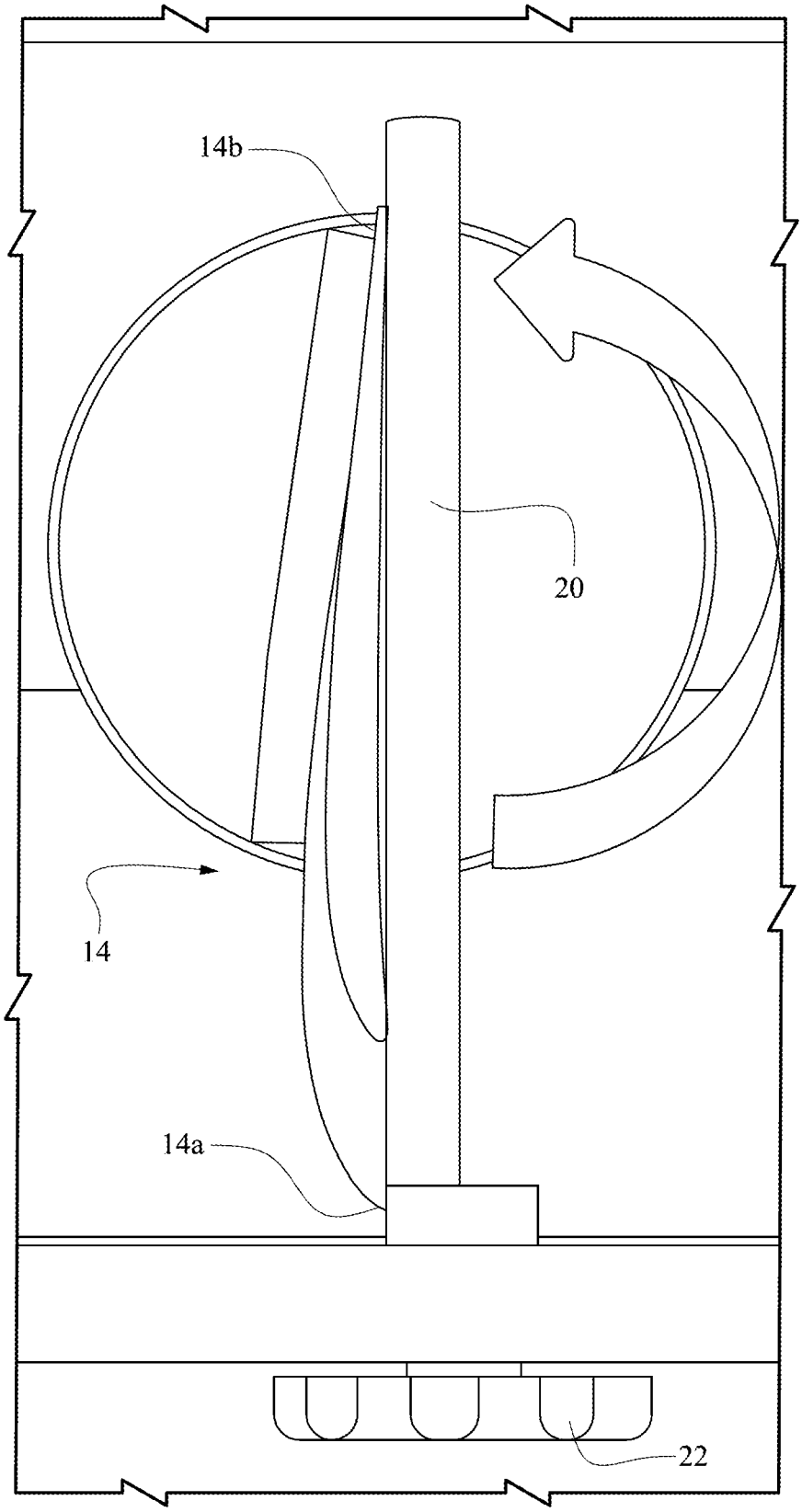
FIG. 3 is a close-up view of an eccentric pin during alignment.
Figure 4:
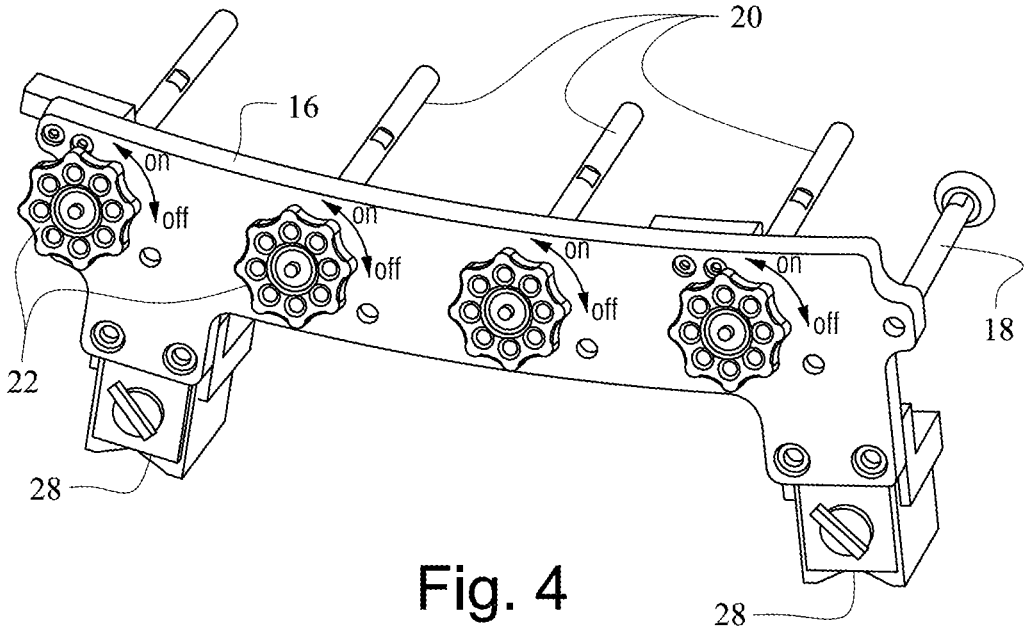
FIGS. 4 and 5 are opposite side perspective views of the alignment tool.
Figure 5:
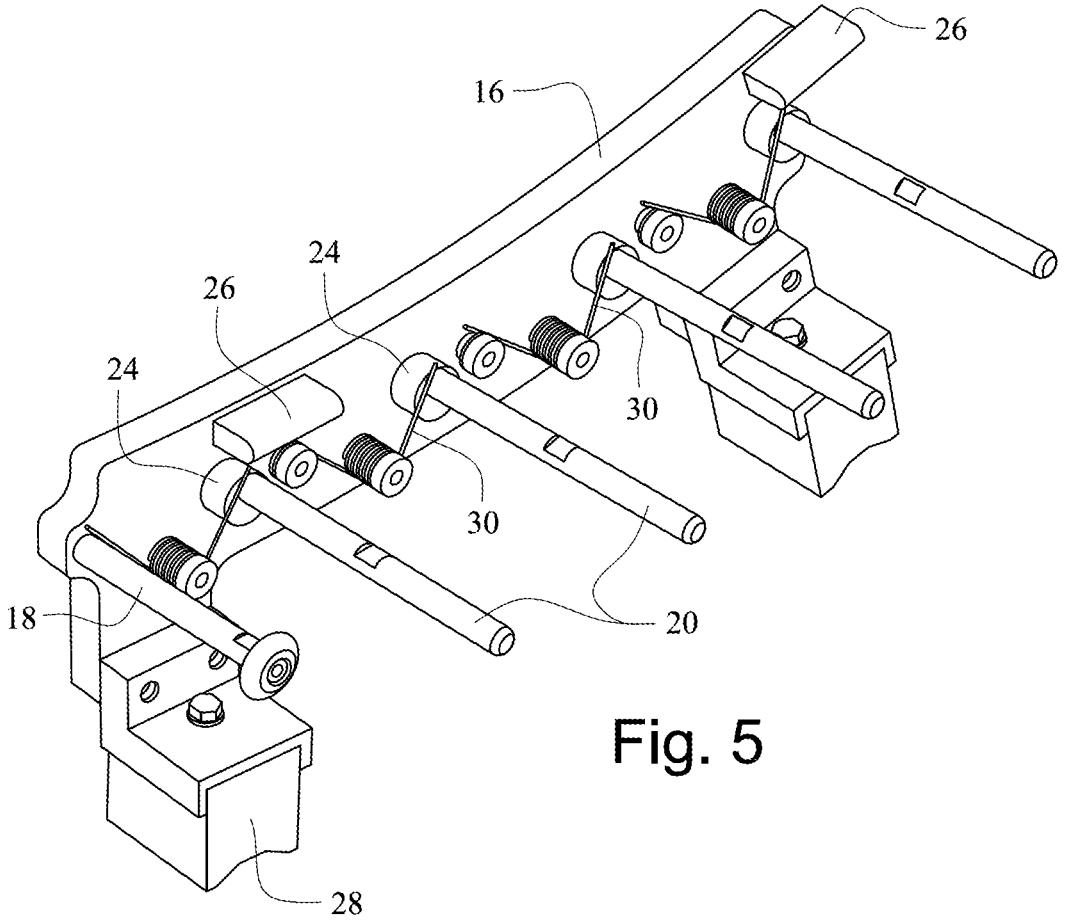

With reference to FIGS. 1-5, the alignment apparatus of the described embodiments aligns the IGVs 14 with the axis 12 of the inlet casing 10. The alignment apparatus includes a tool body 16, a positioning rod or pin 18 secured to the tool body 16, and a plurality of eccentric pins 20 secured to the tool body 16. In some embodiments, the tool body 16 is made from aluminum. The eccentric pins 20 are displaceable via a rotatable dial or hand wheel 22 between an OFF position and an ON position. The rotatable dials 22 may be provided with bearings such as ball bearings or the like. As shown in FIGS. 2, 3 and 5, a shaft 24 associated with each of the rotatable dials 22 is positioned on an opposite side of the tool body 16 from the rotatable dials 22. An axis of each of the eccentric pins 20 is offset, i.e., eccentric, from a rotating axis of the rotatable dials 22/shafts 24. As such, as the rotatable dials 22 are displaced from the OFF position to the ON position, the eccentric pins 20 are displaced laterally as a result of the offset positioning of each eccentric pin 20 relative to the rotatable axis of the dials 22/shafts 24.

Figure 8:
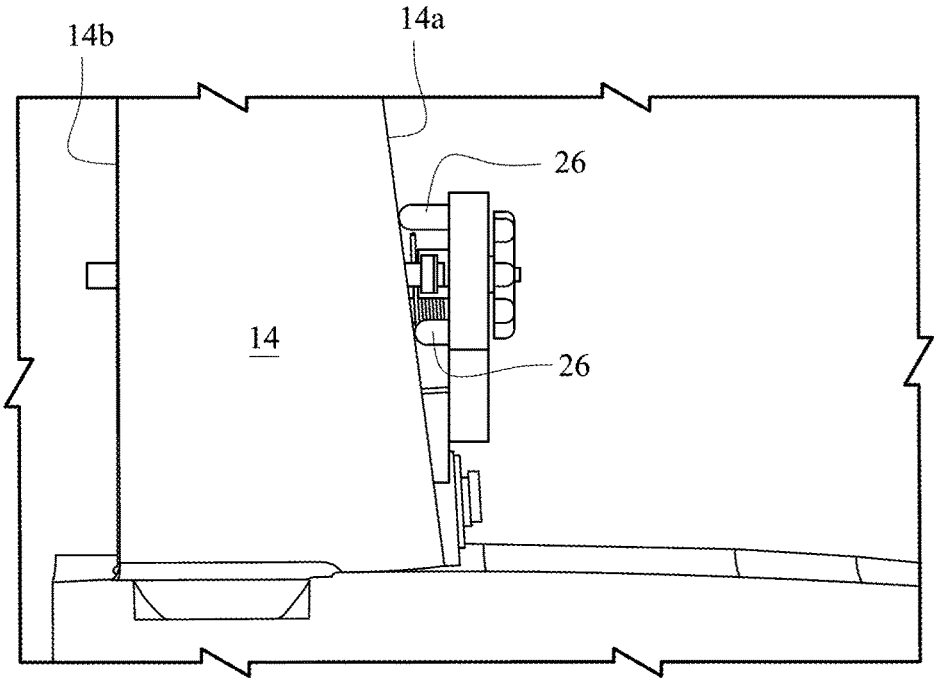

The alignment apparatus may additionally include one or more positioning blocks 26 secured to the tool body 16. The positioning blocks 26 define an axial limit position for the tool body 16 relative to a leading-edge 14*a* of the inlet guide vanes 14. That is, in positioning the alignment apparatus before the alignment process, the alignment apparatus is placed on the inlet casing 10 with the eccentric pins 20 interposed between adjacent IGVs 14. The alignment apparatus is shifted laterally or circumferentially until the positioning rod 18 engages an adjacent one of the IGVs 14, and the alignment apparatus is positioned axially (i.e., along the inlet casing axis) until the positioning blocks 26 engage the leading edge 14*a* of a corresponding IGV 14. In some embodiments, there are two or more positioning blocks 26 secured to the tool body 16 and spaced from each other along a circumferential width of the tool body 16 (see FIG. 5). Additionally or alternatively, the alignment apparatus may be provided with upper and lower positioning blocks 26 secured to the tool body 16 and spaced radially from each other as shown in FIG. 8.

The alignment apparatus may additionally include one or more base blocks 28 secured to the tool body 16. The base blocks 28 are selectively securable to the turbine inlet casing 10. In some embodiments, the base blocks 28 include a magnetic dial or the like for selectively activating and deactivating a magnetic coupling between the base block 28 and the turbine inlet casing 10. In use, the magnetic coupling is initially deactivated while the tool is positioned using the positioning rod 18 and/or the positioning blocks 26. Once the apparatus is properly positioned, the magnetic coupling in the base blocks 28 is activated to secure the apparatus to the inlet casing 10.

In some embodiments, a spring member 30 secured to the tool body 16 is engaged with each of the eccentric pins 20 as best seen in FIG. 5. The spring members 30 are positioned relative to the eccentric pins 20 to bias the eccentric pins to the OFF position when the eccentric pins are disposed in the OFF position and to bias them to the ON position when the eccentric pins 20 are disposed in the ON position. That is, when the eccentric pins 20 are in the OFF position, the spring members 30 apply a spring force to maintain the pins 20 in the OFF position. As the pins are manually rotated by the rotatable dials 22, the pins 20 pass over center as they are displaced to the ON position. The spring members 30 maintain engagement with the eccentric pins 20, and with the pins in the ON position, the spring members 30 apply a spring force to maintain the eccentric pins 20 in the ON position.

In use, a plurality of the tool bodies 16 may be aligned end-to-end and positioned circumferentially over a large portion of the inlet casing 10 as shown in FIG. 6. In this manner, alignment of many or even all of the IGVs 14 can be performed quickly.

Figure 7:
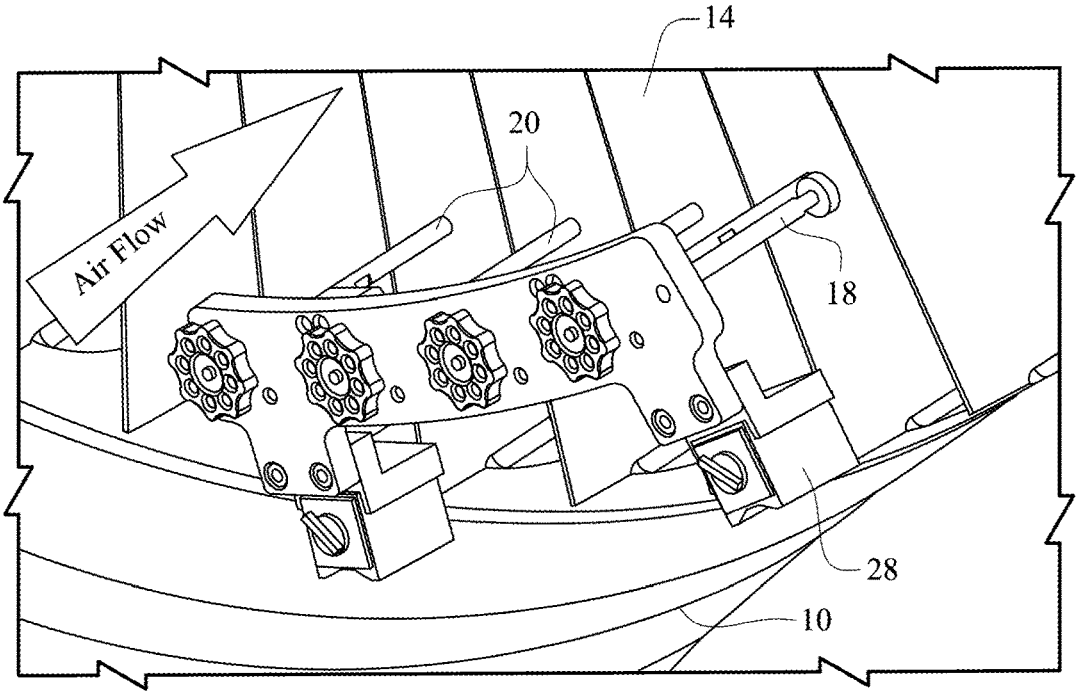
FIGS. 7-12 illustrate an alignment method using the alignment tool of the described embodiment.
Figure 9:
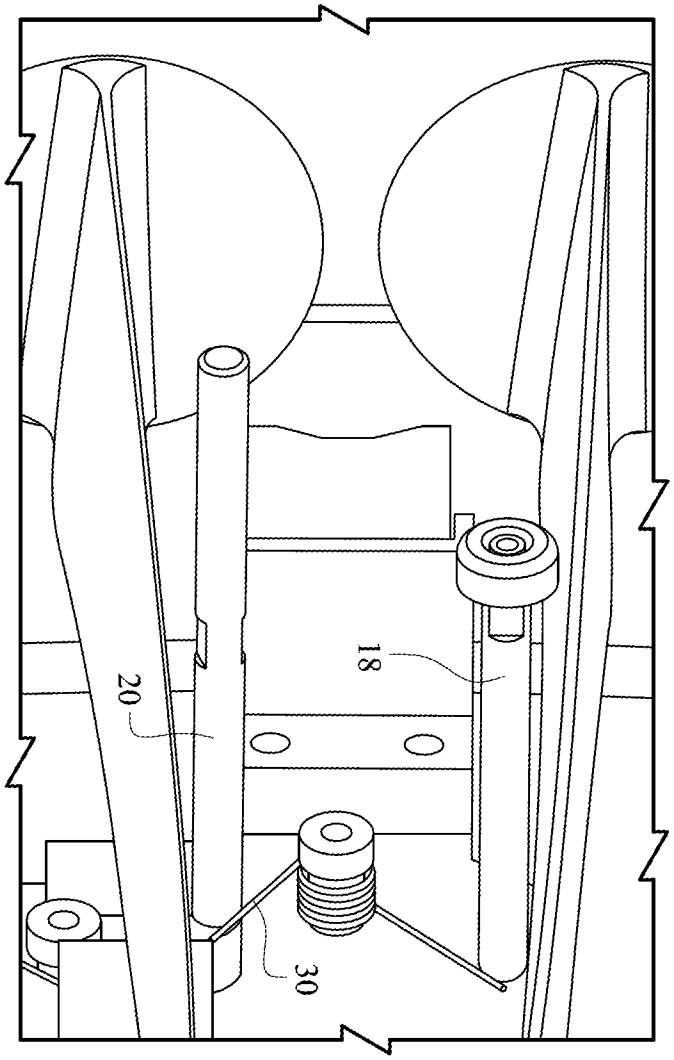
Figure 10:
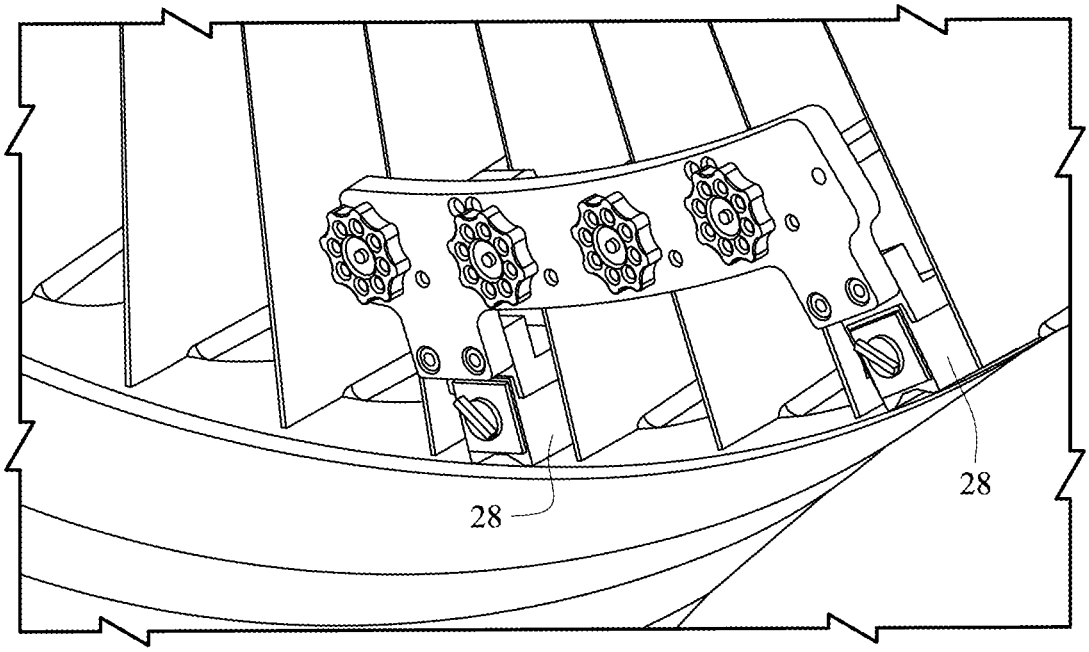

FIGS. 7-12 show a method of aligning the IGVs using the alignment apparatus of the described embodiments. As shown in FIG. 7, the apparatus is placed in the inlet from the upstream side of the inlet casing 10 with the eccentric pins 20 in the OFF position. The magnetic couplings in the base blocks 28 are deactivated. The tool is initially positioned with the eccentric pins 20 interposed between adjacent IGVs 14. As shown in FIG. 8, the tool is moved axially until the positioning blocks 26 engage the leading edges 14*a* of the IGVs 14. As shown in FIG. 9, the tool is then displaced circumferentially until the positioning rod 18 engages an adjacent IGV 14. The positioning rod 18 is affixed to the tool body 16 relative to the plurality of eccentric pins 20 to place each of the eccentric pins 20 adjacent a respective IGV 14 when the positioning rod 18 is engaged with an adjacent IGV 14 and with the eccentric pins 20 in the OFF position. Once the tool is properly positioned axially and circumferentially, the magnetic couplings in the base blocks 28 are activated. Activating the magnetic couplings secures the tool in position for the alignment process.

Figure 11:
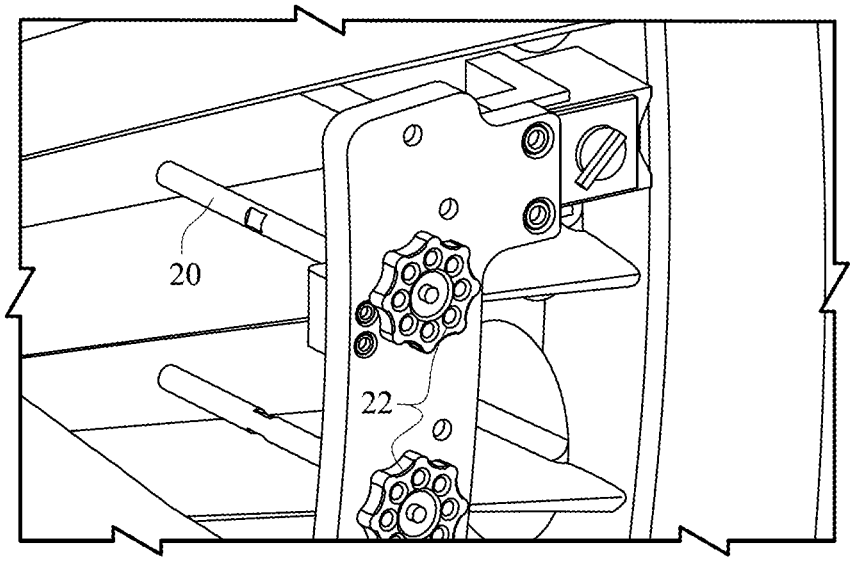
Figure 12:
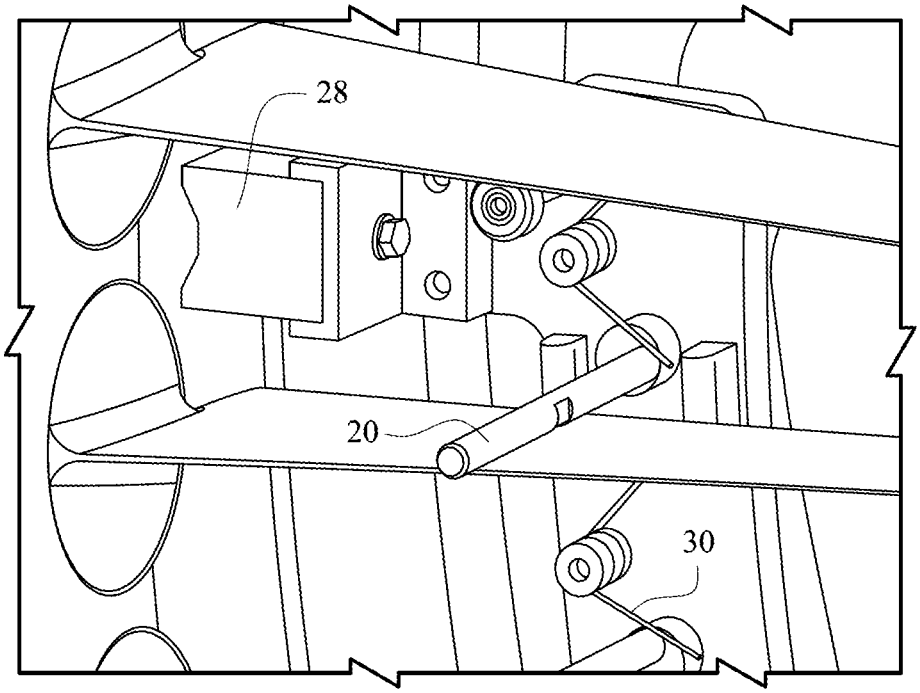

With reference to FIGS. 11 and 12, the eccentric pins 20 are subsequently displaced from the OFF position to the ON position by the rotatable dials 22 or the like. A lock system cooperable with the dials 22 and shafts 24 prevents the eccentric pins 20 from being turned more than 180°. In the ON position, the eccentric pins 20 engage the IGVs 14. With the tool properly aligned, the eccentric pins 20 are parallel to the inlet casing axis 12. The IGVs can then be aligned by rotating the IGVs until both the leading edge 14*a* and the trailing edge 14*b* of each IGV 14 is engaged with the eccentric pin 20. FIG. 3 shows the eccentric pin 20 in the ON position with both the leading edge 14*a* and trailing edge 14*b* of the IGV 14 in engagement with the pin 20. Since the pin 20 is parallel to the inlet casing axis 12, in this position, the IGV 14 is properly aligned.

FIG. 12 shows the spring members 30 applying a spring force to the eccentric pins 20 to maintain the pins 20 in the ON position. In some embodiments, the spring members 30 are torsion springs secured to the tool body 16. The tension or spring force keeps the IGVs 14 in the correct position while pinion gears are installed on the IGV shaft outside the inlet casing 10 to secure the IGVs 14 in place.

Figure 13:
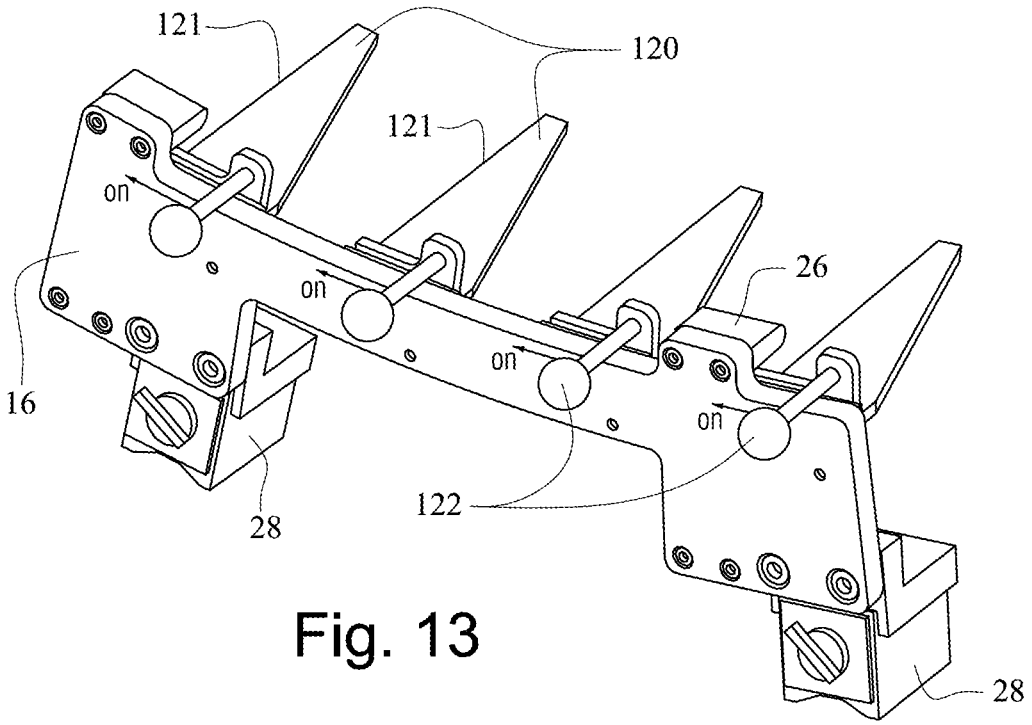
FIGS. 13 and 14 are opposite side perspective views of an alternative alignment tool.

FIGS. 13-18 illustrate an alternative embodiment alignment apparatus. Similar reference numerals are used to designate similar parts. In this embodiment, rather than the eccentric pins 20, the alignment pieces comprise a triangular bracket 120 positionable between adjacent IGVs 14. At least one portion of the triangular brackets 120 such as side 121 shown in FIG. 13 is oriented parallel to the turbine inlet axis when the alignment apparatus is positioned for the alignment procedure.

Figure 14:
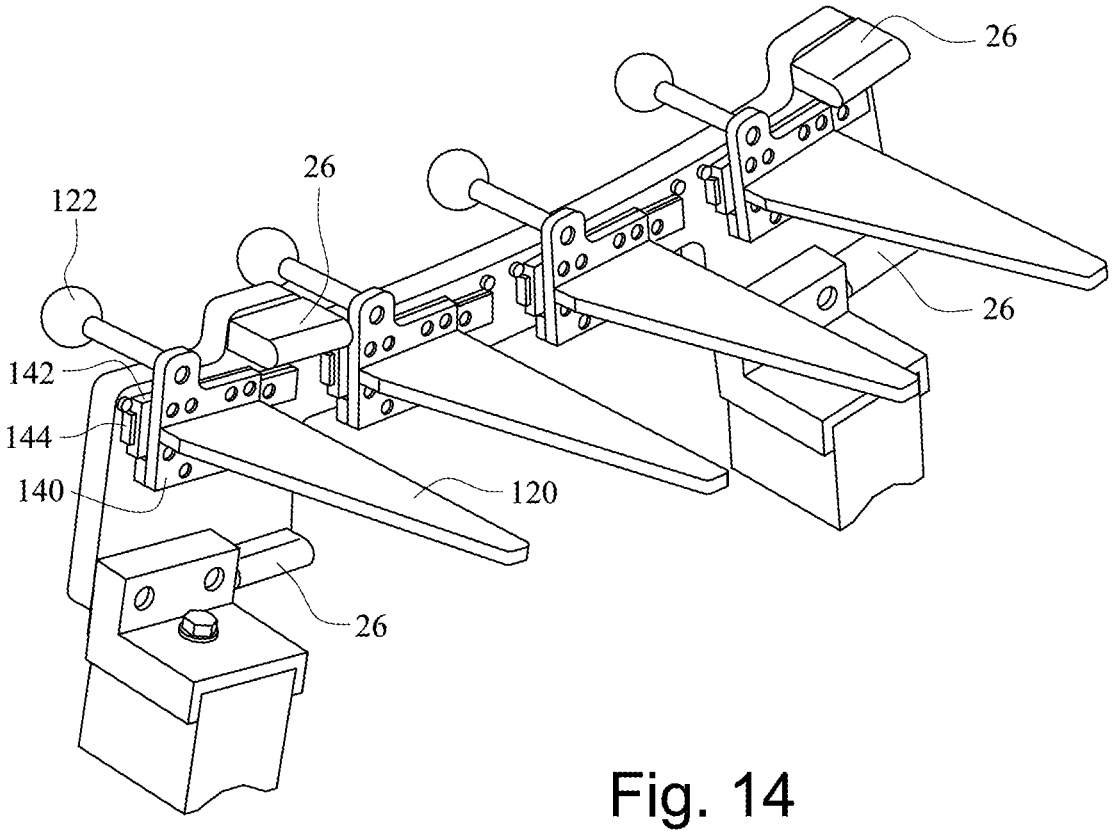
Figure 15:
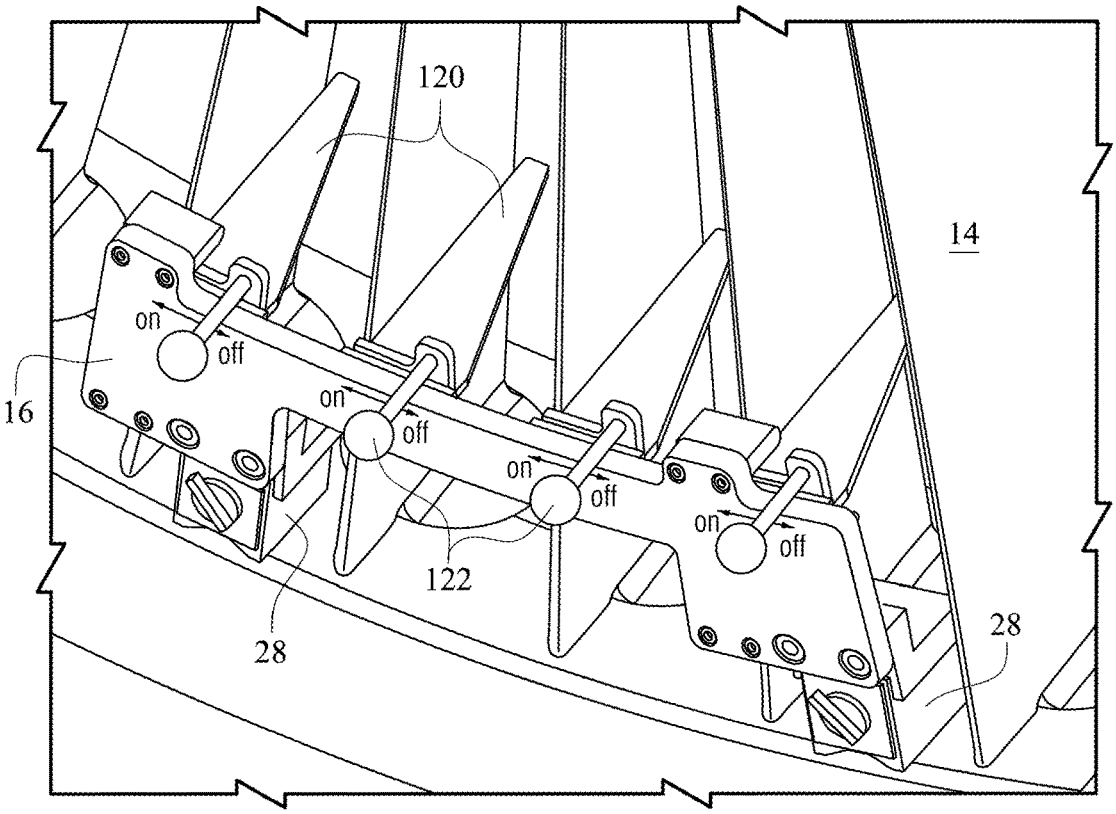
FIG. 15 shows the alternative alignment tool of FIGS. 13-14 secured on the inlet casing during an alignment process.

The triangular brackets 120 are similarly displaceable between an OFF position spaced from the IGVs 14 and an ON position for engagement with the leading edge 14*a* and the trailing edge 14*b* of the IGVs 14. In some embodiments, the triangular brackets 120 are displaceable between the OFF and ON positions by respective handles 122. With reference to FIG. 14, each handle 122 is secured to a bracket plate 140, which in turn is connected to a trolley 142 that is displaceable on a rail 144. In some embodiments, the triangular brackets 120 may be held in the OFF position while positioning the tool by a spring plunger 146 or the like engageable with the bracket plate 140 or the trolley 142 (see FIG. 18). That is, the bracket plate 140 may be provided with an indentation 148 or the like that engages a spring plunger 146 in the tool body 16. During the alignment process, the plate 140 can be detached from the spring plunger 146 by operator displacement with the handle 122.

Figure 16:
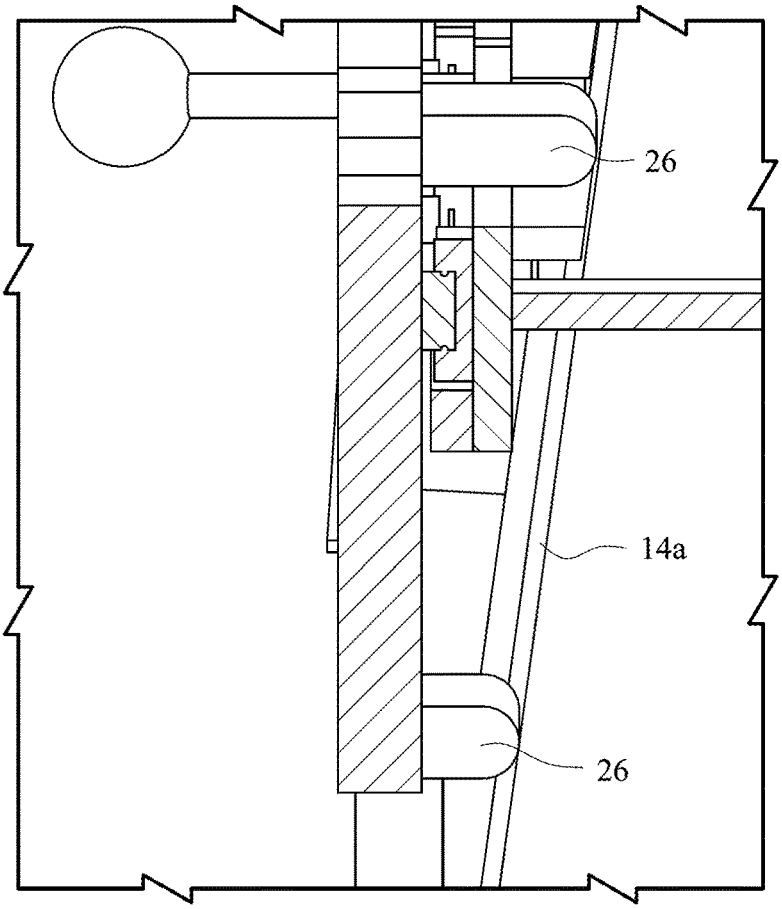
FIG. 16 is a side view of the alternative alignment tool shown in FIGS. 13-14.
Figure 17:
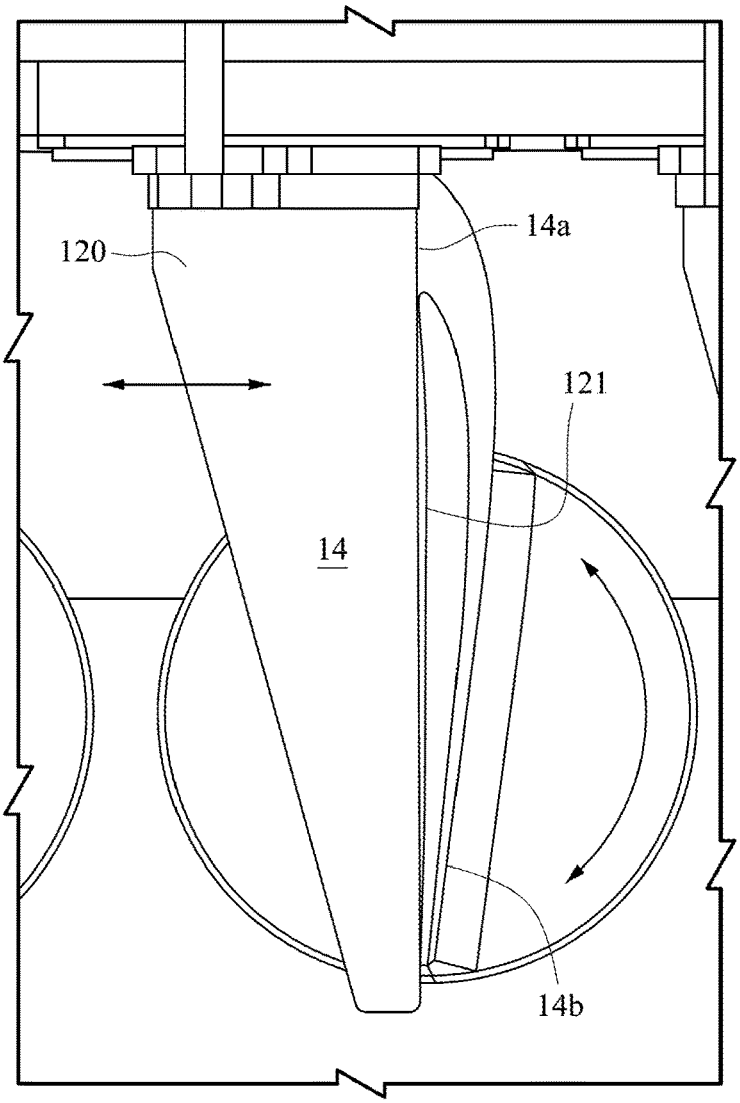
FIG. 17 is a close-up view of the tool according to the second embodiment during an alignment process.
Figure 18:
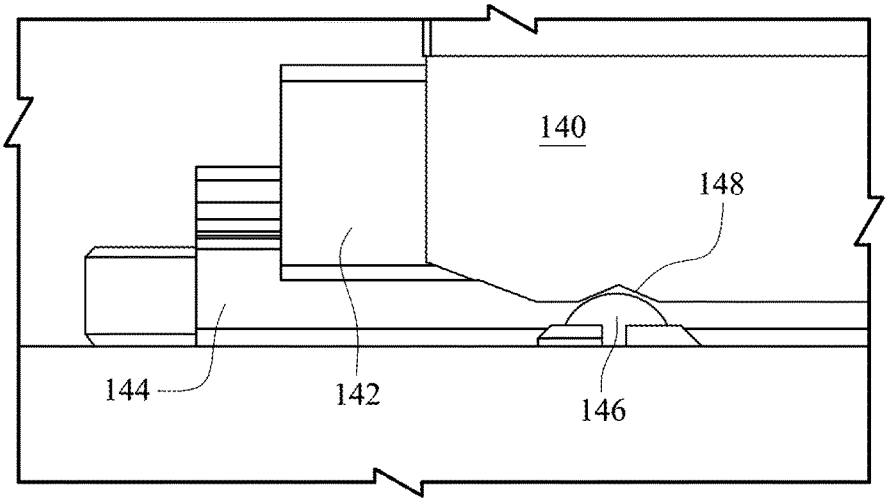
FIG. 18 shows a bracket in the second embodiment held in the OFF position with a spring plunger.

As shown in FIG. 16, the tool is axially positioned when the positioning blocks 26 engage the leading edge 14*a* of the IGV 14. A positioning rod such as positioning rod 18 in the first embodiment, may be included but is not required as the triangular brackets 120 have a larger range of movement than the eccentric pins 20. As a consequence, when the tool is placed in the unit and the positioning blocks 26 engage the IGV, the triangular brackets 120 are positioned to facilitate IGV alignment. Once properly positioned, with reference to FIG. 17, the triangular brackets 120 are displaced from the OFF position to the ON position and the IGVs are adjusted until the parallel side 121 of the triangular bracket 120 engages both of the leading edge 14*a* and the trailing edge 14*b* of the IGV 14. Once all of the IGVs 14 are properly aligned, the IGVs are locked in place in a conventional manner by pinion gears on the IGV shaft outside the inlet casing 10.

After all of the IGVs 14 are properly aligned, the alignment pieces are displaced from the ON position back to the OFF position, the magnetic couplings in the base blocks 28 are deactivated, and the tools are removed from the inlet casing 10.

The alignment apparatus of the described embodiments facilitates the alignment process and enables multiple IGVs to be aligned with the same tool. Additionally, the tool provides for rotor-in inspection/adjustment, thereby considerably reducing alignment/maintenance time.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An alignment apparatus for aligning inlet guide vanes in a turbine having a turbine axis, the alignment apparatus comprising:

a tool body;

a positioning rod secured to the tool body; and a plurality of eccentric pins secured to the tool body, each of the plurality of eccentric pins being displaceable between an OFF position and an ON position, wherein the positioning rod is affixed to the tool body relative to the plurality of eccentric pins, wherein the alignment apparatus is configured to: place each of the eccentric pins adjacent a respective inlet guide vane when the positioning rod is engaged with an adjacent inlet guide vane and with the eccentric pins in the OFF position, align the eccentric pins parallel to the turbine axis, and manually displace the eccentric pins from the OFF position to the ON position into engagement with the respective inlet guide vanes.

2. An alignment apparatus according to claim 1, further comprising a positioning block secured to the tool body, the positioning block defining an axial limit position for the tool body relative to a leading edge of the inlet guide vanes.

3. An alignment apparatus according to claim 2, comprising two positioning blocks secured to the tool body and spaced from each other along a circumferential width of the tool body.

4. An alignment apparatus according to claim 2, wherein the positioning block comprises an upper positioning block and a lower positioning block secured to the tool body and spaced radially from each other.

5. An alignment apparatus according to claim 1, further comprising a base block secured to the tool body, the base block being securable to a turbine casing and including a magnetic dial for selectively activating and deactivating a magnetic coupling between the base block and the turbine casing.

6. An alignment apparatus according to claim 1, further comprising a spring member engaged with each of the plurality of eccentric pins, the spring members being positioned relative to the eccentric pins to bias the eccentric pins to the OFF position when the eccentric pins are disposed in the OFF position and to the ON position when the eccentric pins are disposed in the ON position.

7. An alignment apparatus according to claim 1, further comprising a rotatable dial coupled with each of the eccentric pins, wherein an axis of the eccentric pins is offset from a rotating axis of the rotatable dials.

8. An alignment apparatus according to claim 1, comprising a plurality of tool bodies aligned end to end.

9. A method of aligning inlet guide vanes in a turbine having a turbine casing and a turbine axis using an alignment tool, the alignment tool including a tool body, a positioning rod secured to the tool body, and a plurality of eccentric pins secured to the tool body, each of the plurality of eccentric pins being displaceable between an OFF position and an ON position, the method comprising:

(a) with the eccentric pins in the OFF position, positioning the alignment tool by placing the alignment tool on the turbine casing and engaging the positioning rod with an adjacent inlet guide vane;

(b) securing the alignment tool to the turbine casing; and (c) displacing the eccentric pins from the OFF position to the ON position and engaging the eccentric pins with leading and trailing edges of the inlet guide vanes.

10. A method according to claim 9, wherein the alignment tool includes a positioning block secured to the tool body, and wherein step (a) further comprises engaging the positioning block with one of the leading edges of the inlet guide vanes.

11. A method according to claim 9, wherein the alignment tool includes a plurality of positioning blocks secured to the tool body, and wherein step (a) further comprises engaging the positioning blocks with the leading edges of the inlet guide vanes.

12. A method according to claim 9, wherein the alignment tool includes a base block secured to the tool body and including a magnetic dial for selectively activating and deactivating a magnetic coupling between the base block and the turbine casing, and wherein step (b) is practiced after step (a) by activating the magnetic coupling.

13. A method according to claim 9, wherein the alignment tool includes a spring member engaged with each of the plurality of eccentric pins, the method further comprising positioning the spring members relative to the eccentric pins to bias the eccentric pins to the OFF position when the eccentric pins are disposed in the OFF position and to the ON position when the eccentric pins are disposed in the ON position.

14. A method according to claim 9, further comprising aligning a plurality of tool bodies end to end.

15. A method according to claim 9, wherein step (a) is practiced by positioning the alignment tool from an upstream side of the inlet guide vanes relative to airflow.

16. An alignment apparatus for aligning inlet guide vanes in a turbine having a turbine axis, the alignment apparatus comprising:

a tool body;

a positioning block secured to the tool body, the positioning block defining an axial limit position for the tool body relative to a leading edge of the inlet guide vanes; and a plurality of alignment pieces secured to the tool body, each of the plurality of alignment pieces being displaceable between an OFF position and an ON position, wherein the alignment apparatus is configured to: affix the positioning block to the tool body such that when the positioning block is engaged with a leading edge of one of the inlet guide vanes, at least a portion of the alignment pieces is parallel to the turbine axis, and manually displaceable displace the alignment pieces from the OFF position to the ON position into engagement with the inlet guide vanes.

17. An alignment apparatus according to claim 16, wherein the alignment pieces comprise eccentric pins secured to the tool body.

18. An alignment apparatus according to claim 16, wherein the alignment pieces comprise a triangular bracket positionable between the inlet guide vanes, and wherein the at least one portion of the alignment pieces that is parallel to the turbine axis comprises one side of the triangular bracket.

19. An alignment apparatus according to claim 18, further comprising a rail and trolley for each of the plurality of triangular brackets, the triangular brackets being secured to a respective one of the trolleys, and the trolleys being displaceable circumferentially on the rails to displace the triangular brackets between the OFF and ON positions.

20. An alignment apparatus according to claim 19, further comprising a spring plunger positioned adjacent each of the trolleys that maintains the trolleys in the OFF position.

* * * * *